United States Patent [19]

Hemsath

[11] Patent Number: 4,959,009

[45] Date of Patent: Sep. 25, 1990

[54] PULSE BURNER AND METHOD OF OPERATION

[75] Inventor: Klaus H. Hemsath, Toledo, Ohio

[73] Assignee: Indugas, Inc., Toledo, Ohio

[21] Appl. No.: 371,002

[22] Filed: Jun. 26, 1989

[51] Int. Cl.[5] ..... F23C 11/00

[52] U.S. Cl. ..... 431/1; 122/24

[58] Field of Search ..... 122/24; 431/1

[56] References Cited

U.S. PATENT DOCUMENTS

| | | | |
|---|---|---|---|
| 4,759,312 | 7/1988 | Pletzer | 431/1 |
| 4,808,107 | 2/1989 | Yokoyama et al. | 431/1 |
| 4,856,981 | 8/1989 | Flanagan | 431/1 |

OTHER PUBLICATIONS

"Advancement of Developmental Technology for Pulse Combustion Applications", by American Gas Association, Labs., Mar. 1984.

Sandia Report, by T. T. Bramlette, Feb. 1986, "The ECUT Pulse Combustion Research Program–A Milestone Report".

"Opportunities in Pulse Combustion", by D. L. Brenchley and H. J. Bomelburg, Oct. 1985.

*Primary Examiner*—Carroll B. Dority

*Attorney, Agent, or Firm*—Body, Vickers & Daniels

[57] ABSTRACT

A hybrid burner system is disclosed which incorporates features of continuous burners and pulse combustion devices. A combustion chamber is fitted with one-way air inlet valves, a restricted or one-way exhaust outlet valve and a pressurized, gas inlet which is externally actuated in a periodic manner to produce combustion pulses during operation. The combustion pulses generate heat, force the products of combustion from the burner chamber and cause combustion air to periodically enter the chamber in a self-aspirating manner. Combustion occurs silently during the entire time the fuel is externally pulsed. A spark plug electrode - stabilizing rod arrangement insures consistent ignition while a flame front is stabilized and propagated at the rod. The burner arrangement is self-contained in a recirculating heat exchange application where a pulse opening is provided at a precise position relative to the heat combustion chamber. A pulse line taps the pressure pulses produced during the burner operation which are clamped to provide a fairly constant fluid flow for use in a closed-loop where the burner supplies the heat input to the system.

42 Claims, 4 Drawing Sheets

STARTING CYCLE (INLET VALVES OPEN)

PRIOR ART

POSITIVE PRESSURE CYCLE (INLET VALVES CLOSED)

PRIOR ART

NEGATIVE PRESSURE CYCLE (INLET VALVES OPEN)

PRIOR ART

PULSE BURNER AND METHOD OF OPERATION

This invention relates to a burner and a system for use therewith and more particularly to a burner and system having characteristics of both conventional, continuous burners and also pulsed, combustion driven burners, i.e. a hybrid device.

The invention is particularly applicable to low cost, residential or consumer operated heater applications using a gaseous fuel, and will be described with particular reference thereto. However, the invention has broader applications and can be used not only in industrial burner applications for heating, heat treating, etc., with gas, liquid or solid fuel, but also for various industrial applications where the pressure and/or heat production resulting from the pulses produced during the combustion is to be utilized for some particular application, i.e. fluid circulation or recirculation.

BACKGROUND OF THE INVENTION

Conventional burners, in widespread commercial use today, whether of the residential or commercial type, continuously combust air (oxygen) and fuel. Such burners will be referred to in this specification throughout as "continuous burners". In all such burners, combustion air (or oxygen) and fuel are metered at precise rates into a burner body where the fuel and combustion air is mixed into a combustible mixture and ignited. The combustion is stabilized and a continuous flame is propagated from the stabilization point, the air and fuel being combusted in the flame front. Such conventional burners are consistent and reliable and they are generally quiet. Further, their design, even for highly fuel efficient designs, has developed into widely accepted design principles which are universally followed to yield commercially dependable burners.

Developments in continuous burners have also led to improvements in their turndown ratio. Because turndown ratio can be expressed in different ways, as used herein, "turndown ratio" means the ability of the burner to vary its total heat output over a fixed period of time. In this area development work continues since it is desirable to produce a burner which can maintain stoichiometric to "lean" combustion over a wide turndown ratio. In conventional continuous burner design, turndown is accomplished by varying the rate at which combustion air and fuel are fed into the burner, but not the ratio therebetween which is fixed. Depending on the burner design there is an upper and lower mass flow rate at which combustion can no longer be regularly sustained and this determines the turndown ratio for any particular burner. Another turndown approach which has gained commercial acceptance is referred to as pulsed combustion which is not to be confused with pulse combustion which will be described below. In pulsed combustion, the fuel and air to the burner are periodically regulated to be on-off in variable cycles (usually controlled by microprocessors) and in this manner the total heat output over a given period of time can be regulated. Continuous burners have typical turndown ratios of 3:1 to 6:1 and in some instances have gone as high as 10:1.

In spite of their widespread use, continuous burners have limitations. The turndown ratio, even in pulsed combustion, is limited. Complete combustion is always a problem and even with so-called stoichiometric continuous burners, certain pollutants such as nitrous oxide emissions exist at a level higher than that which would theoretically exist if the combustion were instantaneous for a fixed volume of fuel and air. Inherently, both the gas and air supplied to the burner must be pressurized. Also, a conventional, continuous burner is capable of only heating the work or the environment, although in some heat treat applications the combustion air in the burner may be used to cool the work if the fuel is turned off.

An alternative to continuous combustion is a process known as pulse combustion. Pulse combustion is an old technology. One of the best known examples of a pulse combustor is the German V-1 "Buzz Bomb" used in World War II. A more recent example of a pulse combustor is the recently developed Lennox space heater which is operated as an acoustic Helmholtz resonator. The pulse combustion principle is illustrated in FIG. 1*a*–1*d*.

In FIG. 1*a*, the start-up of the cycle is illustrated. Combustion air 1 and fuel 2 are introduced simultaneously through a pair of flapper valves 3 which function as one-way pressure sensitive check valves. These reactants are mixed in the combustion chamber 4 and initially ignited by a spark plug 5. A rapid combustion (FIG. 1*b*) results which produces a pressure surge that advances upstream to slam shut the inlet valves and block off the entrance preventing further fuel and combustion air from entering the combustion chamber. At the same time, a pressure pulse travels downstream to produce a surge of the products of combustion 6 out of the exhaust duct as shown in FIG. 1*b*. When the products of combustion are discharged from the combustion chamber the pressure in the chamber tends to drop. Inertia causes the products of combustion in the exhaust duct to continue to flow through the discharge duct even after the explosion pressure in the combustion chamber has been dissipated. Conventional, accepted thinking is that the wave motion or pulse of the products of combustion drops the pressure in the combustion chamber below atmosphere with the result that the inlet flapper valves open causing a further mixture of air and fuel to enter the chamber as shown in FIG. 1*c*. The cycle is then repeated. It is also known that the mixture in FIG. 1*c* can be ignited from the hot gas residue of the previous cycle causing the process to be self-sustaining. The process is usually driven acoustically typically at the resonance frequency.

There are several different pulse combustor designs which all operate on the same underlying principle, i.e. the periodic addition of fuel and air must be in phase with the periodic pressure oscillations. In the literature, the pulse combustors are generally identified as the quarter wave or Schmidt tube, the Rijke tube and the Helmholtz resonator. Referring to FIG. 1*a*, the Lennox space heater operates as an acoustic Helmholtz resonator with its small neck replaced by a tailpipe 7. The German V-1 "Buzz Bomb" operated as a quarter wave tube in that the tailpipe as shown in FIG. 1*a* was shaped as an exhaust duct with combustion occurring at a distance x=length/4 which generated a thrust harnessed for propulsion. The Rijke tube is similar to the quarter wave or Schmidt tube and comprises a vertical tube open at both ends which contains a heat source in the center of its lower half, that is at x=length/4. The Rijke combustor is generally used with liquid fuel because the upward flow of heat from the heat source can be utilized to volatilize the fuel to produce the combustion at the desired location. There have been countless design variations. Generally, combustion air may be premixed with the fuel and/or fuel premixed with the air and/or a premixing chamber utilized in conjunction with the combustion chamber. Principally, gaseous fuel can be (1) premixed with entering air; (2) fed continuously to the combustion chamber; (3) supplied from a plenum through a separate aerodynamic valve; or (4) supplied from a tuned chamber. In all pulse combustors, the fuel and air quantities are mixed and then brought, more or less as a total mixture, into an explosive ignition which produces the noise associated with the devices, and generates the pulsed pressure waves which control the fuel and air combustion. Typically, flapper valves as shown in FIGS. 1*a*–1*c* simultaneously admit and mix the fuel and air as they are drawn into the combustion chamber. In the tube arrangements discussed, the air may be drawn into the tube vis-a-vis a flapper valve while the fuel is emitted downstream in the tube. The fuel and air mix as they travel further downstream to the point where the total mixture is explosively ignited and this ignition/combustion produces the noise and shock typically associated with pulse combustion.

As thus defined, pulse combustors are generally recognized to have certain advantages over the steady state combustion employed in continuous burners used in most boilers and furnaces. The advantages include:

(a) Because of the sudden combustion, pulse combustors are believed to have combustion intensities that are up to an order of a magnitude higher than conventional burners.

(b) Pulse combustors are generally believed to have heat transfer rates that are a factor of two to three times higher than continuous burners. This results because in most pulse combustors, the combustion occurs near the closed end of a tube where inlet valves operate in phase with pressure amplitude variations to produce localized temperature and pressure oscillations around a mean value. More specifically, it is known that flow oscillations can significantly increase beat transfer over steady turbulent flow and the oscillations, if large enough, can in themselves create additional turbulence increasing heat transfer. This means that more heat can be removed with a smaller more compact heat exchanger thus decreasing the overall cost of a furnace or heater.

(c) Because of the suddenness of the combustion, it is generally believed that nitrous oxide emissions are reduced or lowered by as high a factor as three.

(d) Finally, pulse combustors are inherently self-aspirating since the combustor generates a pressure boost. This obviates the need for a blower and also permits the use of a compact heat exchanger that may include a condensing section which obviates the need for a chimney or a draft, an important consideration in many applications.

While the advantages of pulse combustion when compared to conventional steady state combustion devices are significant, there are serious disadvantages associated with pulse combustion which has heretofore prevented their wide scale commercial acceptance. The disadvantages include:

(i) All pulse combustion systems produce objectionable noise whether the systems are acoustically driven or otherwise. This is inherent because the combustible mixture is formed from the complete charge which produces an explosive ignition. A typical approach which is followed to mute the noise is a system using pairs of pulsed combustors which must be operated in phase at or near resonance so that the pressure or noise from one unit cancels the noise or pressure pulse of the other. The pressure or noise is not eliminated and along with the noise is shock resulting from the explosion. The chamber and tail pipe have to be designed to withstand the shock.

(ii) The second principal defect present in current pulse combustors is the fact that they posses little if any turndown ratios. For example, acoustically driven pulse combustors operate at one combustion speed, the resonance frequency. As noted above, all pulse combustors are operated in self-sustaining phase such that the fuel and air is admitted in periodic phase relationship with the pressure oscillations resulting from the explosion of the air and fuel. This means that the entire arrangement has to simply be operated on/off to achieve turndown. Any attempt to achieve turndown by varying the charge of fuel plays havoc with the interaction of combustion chamber geometry and combustion oscillations which are precisely configured to insure sudden combustion at a fixed volume of fuel and combustion air.

(iii) Finally, and notwithstanding the commercial success of certain prior art pulse combustion systems such as the Lennox system, there is in general a reliability or consistency problem affecting prior art pulse combustion systems. As noted, the success of any pulse combustion system is critically dependent on the geometry of the combustion cavity and this geometry is presently determined by trial and error to produce a specific combustor geometry for a specific application which is characterized by a narrow turndown ratio and some form of attachment to mute the noise resulting from ignition explosion. The design parameters which permit consistently reliable pulse combustion burners to be built have not been developed.

SUMMARY OF THE INVENTION

Accordingly, it is a principal object of the present invention to provide a hybrid pulse type burner and system which retains and combines, to some extent, the advantages of conventional prior art pulse burners with those of continuous burners to provide a new improved burner along with systems which take advantage of the new burner's features.

This object along with other features of the invention is achieved in a device which includes conventionally a combustion chamber having a one-way air inlet permitting combustion air to enter the combustion chamber but preventing any of the contents of the chamber from being exhausted through the inlet. Similarly, a one-way exhaust opening is provided which permits the contents of the combustion chamber to be exhausted through the exhaust opening but prevents ambient atmosphere from communicating with the combustion chamber. A fuel inlet is also provided as well as an igniter and stabilizer. A timer or timing arrangement externally drives the burner in a predetermined but variable sequence which comprises a first predetermined interval whereat combustion air is admitted into the combustion chamber and a second predetermined interval during which a fixed quantity of fuel is injected into the combustion chamber. During the second timed interval, the fuel is mixed, ignited and combusted. More specifically, while the fuel is introduced into the combustion chamber, it begins mixing with the combustion air inside the chamber to form a combustible mixture which is ignited while still in formation to initiate a soft ignition, i.e. one which results in a soft pressure pulse which can be made virtually noiseless, in contrast to the sharp, loud noise of an explosion characteristic of prior art pulse combustors. The combustion and soft ignition continues throughout the entire second time interval as long as fuel is admitted and shortly thereafter. At the same time, the combustion process, even though occurring over a finite measured time interval, nevertheless produces a fast rise in temperature and pressure sufficient to create a forceful pressure pulse which can be harnessed and used to increase heat transfer, lower $NO_x$ emission and induce self-aspiration in a manner not dissimilar to that of prior art, pulse combustion systems.

In accordance with another important feature of the invention, the timing of the intervals can be varied while the burner is in operation to provide a wide turndown ratio. Preferably, the first time interval can be varied from a minimum time period which is the time it takes, dependent upon inlet valve design, to fill the combustion chamber with combustion air to a maximum time period which can, in theory, be any time period to produce turndown ratios not capable of being achieved even by continuous burners. Further, the inlet valve design is such to permit self-aspiration of all the combustion air required to fill the combustion chamber without need of external blowers. Alternatively, it is possible to vary the second time interval to produce a smaller heat output per pulse resulting in essentially a fuel lean operation versus the close to stoichiometric operation which should be attempted at the maximum length of the second time interval. Therefore, the new device can be operated over a wide range of fuel input rates which convincingly shows that the combustion process is not particularly sensitive to combustion chamber geometry, at least to the extent of pulse combustion burners.

In accordance with another feature of the invention, consistency and reliability of operation is achieved by sensitizing the design through the air fuel timing arrangement which can be easily achieved with conventional, state of the art timing devices and simple circuits. The combustor geometry is not critical to the operation of the system at least not in the sense that geometry is critical to prior art pulse combustion systems and, thus, a wide variety of combustion chamber designs and geometries is permissible. In addition, because of the independently timed nature of the device, a fuel inlet one-way valve, used on a number of Helmholtz resonators is not required.

In accordance with a more specific feature of the invention, a particular burner design configuration is shown and the dimensional relationship and ratios are disclosed for several burner characteristics in the detailed specifications which permit the burner to operate at optimum efficiency in a consistently reliable manner. Apart from the dimensional relationships, the orientation of a spark plug electrode and a self-stabilizing rod within the burner, as described further herein, was found to produce a "soft", almost inaudible ignition of the fuel and gas in a consistently repeatable, reliable manner. This arrangement besides generating a spark for ignition also stabilizes the combustion of the air and fuel permitting a steady and consistent flame front to be propagated at the stabilizing rod despite any system variations that inevitably occur which affects gas pressure or on time. The dimensional relationships, the use of a stabilizing rod which serves as a source of ignition, and the combination thereof are all features of the burner which provide a low noise, consistent and reliable device.

In accordance with a still more specific feature of the invention, a uniquely developed system using certain advantages of the hybrid burner is disclosed in the detailed specifications. The system, suitable for installation and use by the general public avoids any need of a chimney draft to sustain combustion, or the requirement of a chimney to vent the products of combustion. Additionally, the system acts during combustion as a pump for providing whatever work may be required either as a part of the system to which the burner is attached or as a separate source of power for driving an auxiliary device.

Specifically, the burner is modified to provide a pulse opening therethrough rearward of the burner's ignition point. In each combustion cycle, a pressure pulse is pushed through the pulse opening twice. This occurs during combustion when the combustible gas and combustion air are ignited and combusted (the combustion stroke), to develop a forceful pressure pulse (i.e. the exhaust stroke) and also when combustion air is drawn into the combustion chamber during self-aspiration of the burner (i.e. the intake stroke). The rapidity of the pulses through the pulse opening provides a surprisingly high mass flow at a significant pressure. A simple inlet and outlet standpipe arrangement is then provided in a closed loop, hydronic fluid system which may be heated by the burner to dampen any sudden pressure surges which otherwise may be imparted to the system. Finally, the burner when supplied as a system is provided with a casing surrounding its inlet end and a single fitting containing an air line with a gas line inside the air line is the only contact between ambient atmosphere and burner (apart from the exhaust line which is vented) so that the burner is completely self-contained and explosion-proof.

Accordingly, it is an object of the present invention to develop method and apparatus for a pulse combustion type system which has little or no noise in operation and does not require mufflers or other arrangements for muting noise produced during ignition of the combustible mixture.

It is another object of the present invention to provide method and apparatus for a burner which has a wide turndown ratio.

It is another object of the invention to utilize steady state, conventional burner principles to produce a pulsed flame type combustion system which combines the most desirable characteristics of prior art pulse combustion systems and continuous burner type systems.

It is another object of the invention to produce a pulse combustion type system which emulates prior art pulse combustion systems as defined in the background hereof.

It is yet another object of the invention to provide a pulse combustion system which operates in a consistent and reliable manner.

It is yet another object of the invention to provide a pulse combustion system which has simple design criteria to permit the system to be reproduced by others without extensive trial and error experimentation.

It is another object of the invention to supply a combustion device which is particularly adaptable to rather small heat inputs and which can be used in applications where small heat inputs are required on an intermittent basis.

Yet another object of the invention is to produce a pulse combination system which has fewer and less costly parts than prior art systems.

Still yet another object of the invention is to provide a system which generates a sequence of intermittent combustions in a burner which when compared to conventional burners possesses any or all of the following features:

(a) self-aspiration of combustion air obviating need for combustion air blower, (b) reduced $NO_x$ emissions, (c) higher heat transfer performance, (d) fuel savings, and (e) chimney or draft device elimination.

It is still yet another object of the invention to provide a pulse combustion system which can be constructed with a small amount of relatively inexpensive components to produce an inexpensive system ideally suited for residential applications requiring only a small amount of low voltage electric power to operate.

Still yet another object of the invention is to produce a combustion system which is operable as a heat pump.

Still another object of the device is to provide a hybrid type burner and system suitable for use in residential heating and/or cooling applications and in other similar applications such as RV vehicles or marine applications.

Yet another object of the invention is to provide a closed loop, hydronic fluid, heat exchange system for use with a device which provides a series of pressure pulses.

Still yet another object is to provide an external fluid system, closed loop or otherwise, where the fluid is driven by the burner at a fairly constant mass flow.

These and other objects and advantages of the present invention will become apparent to those skilled in the art upon reading and understanding of the following description taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 6 is a side elevation view, partially in section, schematically illustrating the hybrid burner of the present invention and its use in a unique system, specifically suited for a marine application.

DETAILED DESCRIPTION OF THE PREFERRED EMBODIMENT

Figure 3:
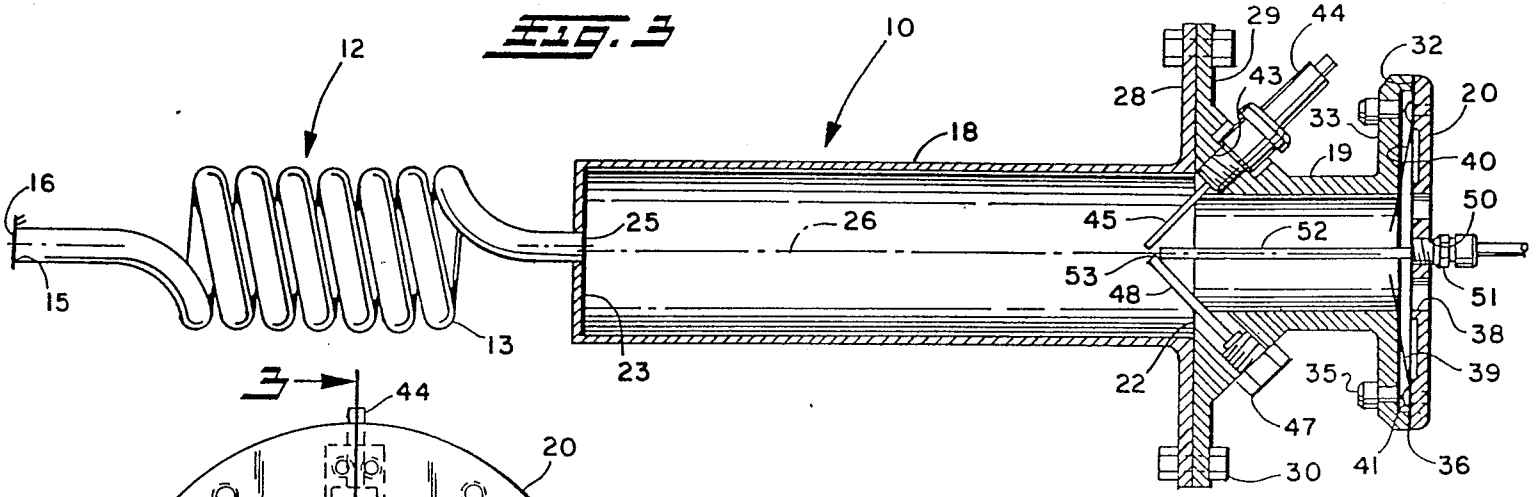
FIG. 3 is an elevation view, partly in section, of the hybrid burner of the present invention taken along lines 3—3 of FIG. 2.
Figure 2:
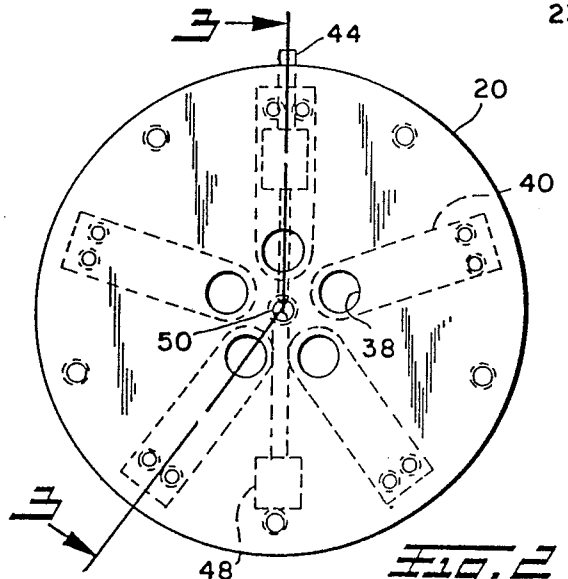
FIG. 2 is an end view of a hybrid burner of the present invention.

Referring now to the drawings wherein the showings are for the purpose of illustrating a preferred embodiment of the invention only and not for the purpose of limiting the same, FIGS. 2 and 3 show a burner 10 of the present invention which is shown in FIG. 3 to be connected to a heat exchanger 12 which comprises essentially a series of spiral coils 13. Heat exchanger 12 is not part of burner 10 but is shown in FIG. 3 attached to burner 10 to illustrate what the inventive arrangement would look like if it were applied in a residential hot water heater. That is, burner 10 with heat exchanger 12 would simply be dropped into a conventional water jacket casing and the outlet 15 of heat exchanger 12 would be vented to atmosphere probably through an existing chimney although any vent to the outside could be used. (As will be discussed later, only a fuel inlet is required. The draft from the chimney is not needed to sustain combustion in burner 10, nor are any auxiliary fans or blowers.) At outlet 15 is shown a flapper valve 16 which functions as a one-way check valve. Whether or not a one-way check valve like flapper valve 16 is required, depends upon the back pressure resistance produced by heat exchanger 12 relative to burner 10 which in turn is a function of heat exchanger length including number of coils 13 and this in turn is correlated to burner size, tank capacity, etc. If the back pressure produced by heat exchanger 12 is high enough, a one-way check valve like flapper valve 16 is not needed because the resistance created by heat exchanger 12 will act as a one-way valve.

Burner 10 is shown in FIGS. 2 and 3 to comprise a simple three-piece construction which includes a combustion chamber 18, a feed chamber 19 abutting one end of combustion chamber 18 and an end plate 20 closing the opposite end of feed chamber 19. Theoretically, combustion chamber 18 could be any tubular shape. Preferably combustion chamber 18 is cylindrical having an open axial inlet end 22 and a closed outlet end 23 at its opposite end. An outlet 25 is provided in outlet end 23. Generally outlet 25 is circular in configuration and in the arrangement shown in FIG. 3, outlet 25 is centered on longitudinal center line 26 of burner 10. It is not necessary to position outlet 25 in the center of outlet end 23 for burner 10 to operate or operate efficiently. Theoretically, burner 10 will operate if outlet 25 were placed in the cylindrical portion of combustion chamber 18. However, for cycle stability and efficiency, it is desirable to place outlet 25 in the closed outlet end 23. A flange 28 is provided at inlet end 22 and permits burner 10 to be mounted to the casing of whatever device burner 10 is to heat.

Feed chamber 19 is preferably cylindrically shaped with a flange 29 at its outlet which abuts flange 28 and is secured thereto by appropriate fasteners 30 which compress a seal (not shown) therebetween to make the Joint airtight. The inlet end of feed chamber 19 is annularly shaped as at 32 from which a recessed flange 33 depends radially inwardly. Bolted to recessed flange 33 as by cap screws 35 is end plate 20 and a gasket 36 is provided between end plate 20 and annular shaped surface 32 to insure a gas-tight joint. The orientation of feed chamber 19 relative to combustion chamber 18 is such that the longitudinal center line of feed chamber 19 is coaxial with longitudinal center line 26 of combustion chamber 18.

End plate 20 as best shown in FIG. 2 has a plurality of combustion air openings 38, there being five such openings for the burner shown in FIGS. 2 and 3. Combustion air openings 38 are preferably circular in shape with the center of each combustion air opening 38 positioned on the circumference of an imaginary circle of a predetermined diameter struck from the center point of end plate 20. Formed between recessed flange 33 and end plate 20 is an annular chamber 39 and reeds 40 secured as by machine screws 41 to the inside surface of end plate 20 extend from annular chamber 39 to cover combustion air openings 38. The mounting arrangement described and the size of reeds 40 is such that each reed normally extends over and covers combustion air openings 38. Reeds 40 prevent communication of air with the interior of feed chamber 19 when a pressure is developed within combustion chamber 18 (and likewise feed chamber 19) which is greater than the ambient atmosphere. Because reeds 40 are flexible, they will not effect an airtight seal when burner 10 is at rest. Upon a suction or a drop in pressure within feed chamber 19 relative to the ambient air pressure, each reed will flex because of the space permitted in annular chamber 39 to uncover and permit direct communication between combustion air openings 38 and the interior of feed chamber 19 in combustion chamber 18 so that combustion air can be rapidly drawn into the chamber. Similarly, upon a buildup of pressure within combustion chamber 18 and feed chamber 19, reeds 40 will be biased against end plate 20 to seal combustion air openings 38. Other one-way mechanical valve arrangements as well as, in theory, aerodynamically valved arrangements, known to those skilled in the art can be employed. However, flapper type valves and particularly reed valves are simple, economical and reliable and for the frequencies employed, are preferred. For instance, the reed valves used in a prototype design built for residential home hot water heating applications were purchased from Sears, Roebuck and Co. The reed valves worked fine.

The juncture of flange 29 with the cylindrical section of feed chamber 19 is thickened to provide a threaded opening 43 for a spark plug 44 which has an electrode 45 which extends at a precise geometric relationship into combustion chamber 18 and more specifically extends to a point just short of longitudinal center line 26 to form an acute angle therewith as shown in FIG. 3 of approximately 45°. Similarly on the opposite side of and at the juncture between the cylindrical section of feed chamber 19 and flange 29 is another threaded opening 47 into which is inserted a stabilizing rod 48. Stabilizing rod 48, as in the case of electrode 45 extends into combustion chamber 18 in a precise geometric relationship to a point positioned on longitudinal center line 26 and to form with center line 26 an acute angle as shown in FIG. 3 of approximately 45°. As shown in FIG. 2, stabilizing rod 48 extends 180° opposite that of electrode 45 while stabilizing rod 48 and electrode 45 form a 90° included angle when viewed in FIG. 3, i.e. in a plane which is orthogonal to the plane of FIG. 2. While burner 10 could operate with spark plug 44 at different positions in combustion chamber 18 and with or without an electrode 45 which extends almost to longitudinal centerline 26, or alternatively with an electrode 45 which has a grounding rod extending from spark plug 44, it has been discovered that causing electrode 45 to spark or ground against stabilizing rod 48 produces a very stable flame propagation point and surprisingly reduces the noise resulting from ignition when the burner is operative to be almost inaudible to the human ear, at least no more than a low whisper. (Estimated decibel range would be about 60 to 70.) Specifically, through the development of various prototypes, it was determined that it was possible to operate burner 10 as a periodic combustion device in the manner to be discussed with a number of spark plug positions and various stabilization zones within combustion chamber 18. In all instances combustion pulses generated very low noise levels. However, when the fuel input and/or cycle time was varied, noise could increase or burner stability could become a problem. For example, with some earlier designs, water vapor would condense and interfere with firing when the burner was mounted horizontally. With the electrode 45-stabilizing rod 48 arrangement disclosed, burner operation became very stable, practically insistive to the off time of the fuel, capable of sustaining periodic combustion with a very "lean" fuel mixture, and most surprising of all, resulted in almost noiseless ignition. Thus, stabilizing rod 48 functions as a ground for electrode 45 so that a spark jumps the gap therebetween and then also functions as the stabilization point for the burner in that the burner flame develops and propagates from that point through combustion chamber 18.

A threaded opening 50 is provided at the center of end plate 20 and a coupling 51 threaded therein. Coupling 51 supports a gas tube 52 which extends into feed chamber 19 and has an orifice outlet 53 which is positioned at a predetermined distance from the intersection point of electrode 45 with stabilizing rod 48.

Figure 4:
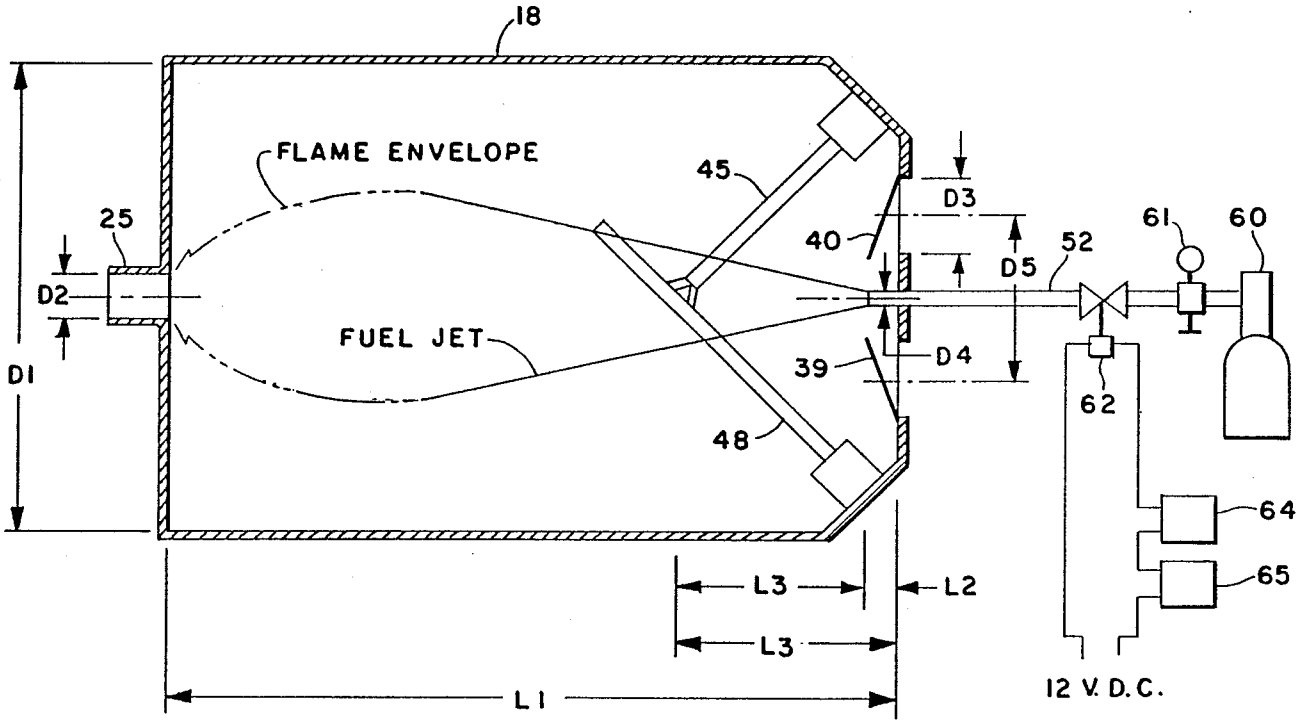
FIG. 4 is a schematic illustration of a side elevation view of a hybrid burner of the present invention incorporating the fundamental components needed to make the device function in the system.
Figure 5:
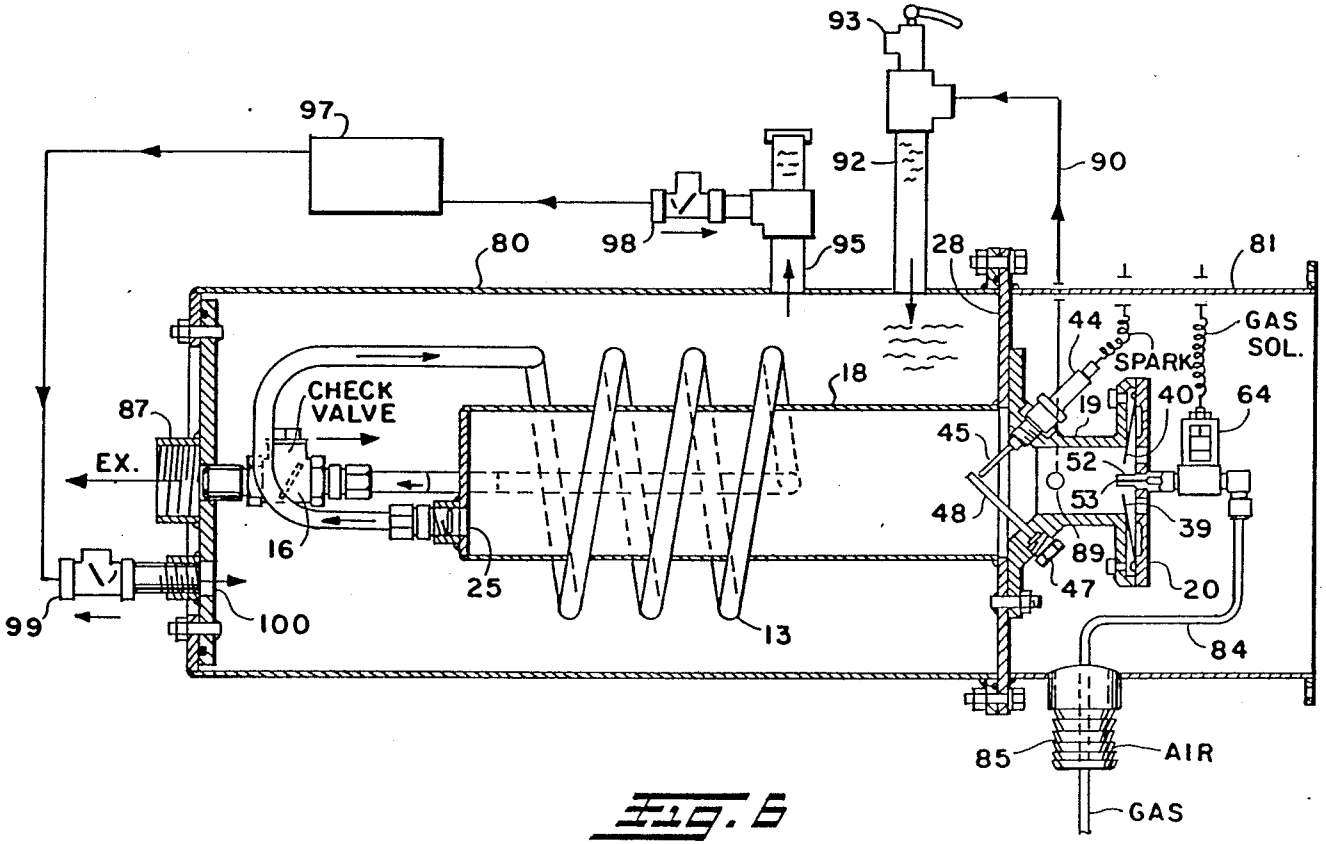

Referring now to FIG. 4 there is shown in schematic form a burner 10 which illustrates the principle components of the invention, namely a combustion chamber 18 (feed chamber and end plate 19, 20, respectively, conceptually incorporated into combustion chamber 18, superfluous), a gas orifice 53, an inlet valve 40 (heretofore designated as reeds 40 and combustion air openings 38), an exhaust outlet 25 (and in combination therewith a one-way flapper valve 16) and an igniter or spark plug 44 which preferably takes the form of electrode 45 and stabilizing rod 48. While combustion chamber 18 can assume any number of configurations, one of the objects of the invention is to establish burner design parameters and this is done with respect to the simplest combustion chamber shape which is a cylinder. The key dimensions of burner 10 are designated as length dimensions or diameter dimensions in FIG. 4 and have been determined in the operation of a satisfactory prototype to be about the values specified in tabular form below:

CYLINDRICAL BURNER DIMENSIONAL DATA

| Length Dimensions | Width Dimensions (Diameters) |
|---|---|
| $L_1$ = 12 in. | $D_1$ = 3.5 inches |
| $L_2$ = 3 in. | $D_2$ = 0.5 inch |
| $L_3$ = .5 in. | $D_3$ = 0.5 inch |
| | $D_4$ = 3/64 inch |
| | $D_5$ = 1.5 inches |

Volume & Area Considerations
Volume of Combustion Chamber = 115 $in^3$
Area of Exhaust = 0.2 $in^2$
Area of Intake = 1 $in^2$
Gas Orifice Size = 3/64 @ Gas Pressure = 2 to 64 inches W.C.

To some extent, all the dimensional relationships are interdependent and somewhat linear for size scaling purposes. However, some relationships are more critical than others. For example, the air inlet size is not especially critical so long as it provides a sufficient volume of combustion air to combustion chamber 18 within the "off time" as explained hereafter. The area of the exhaust opening 25 obviously must be small enough to create the pressure pulse but once the pulse is created, it is not especially critical to further reduce the area to increase pulse intensity. It has, however, been determined that, given a sufficient volume of gas and a mixing pressure, the ratio between the diameter of gas nozzle $D_4$ and the distance from the point of ignition, i.e. stabilizing rod 48, to the exhaust opening 25 must be between 175 and 250 to 1 to sustain consistent repeatable ignition and combustion. Also, the distance from the gas nozzle to the ignition point is a function of nozzle diameter and combustion chamber size and has a bearing on ignition and flame front propagation.

More particularly, FIG. 4 besides illustrating the dimensional relationships of the burner also illustrates the essential elements of what is needed to make burner 10, per se, operate. All that is basically needed is a source of gas 60 under constant pressure via regulator 61, ported through a valve 62 which is controlled in its on/off or open/closed position by any conventional timing device or circuit, obviously a low voltage device being preferred. In FIG. 4, two low voltage variable solenoids 64, 65 are shown to control valve 62. One solenoid, say solenoid 64, variably controls the on time of valve 62 while the other solenoid 65 variably controls the off time of valve 62. In commercial arrangements, only one solenoid which will vary the off time of valve 62 will be used. In any event, valve 62 is connected to gas tube 52 and the gas is pulsed into combustion chamber 18. Specifically, the size of nozzle orifice 53 and gas line pressure is such to cause the gaseous fuel to be emitted from nozzle 53 as a free-standing jet which will expand as a cone in combustion chamber 18. The velocity or intensity of the jet is sized relative to the size and shape of combustion chamber 18 to cause the fuel to be entrained with the stationary combustion air. As the jet travels past the ignition point, it continues to entrain and mix the combustion air with the gaseous fuel causing propagation of the flame front until the jet becomes spent. To keep the arrangement simple, the jet is sized not to impinge the cylindrical walls of combustion chamber 18 before it is spent. The jet is also positioned so that its center passes through the spark generated between electrode 45 and stabilizing rod 48. In the prototype model discussed above, the source of gas was propane supplied from a conventional 20 lb. bottle through a conventional regulator at a pressure of 4.5 lbs/im$^2$ max.

BURNER OPERATION

Burner 10 operates somewhat similar to continuous burners and somewhat similar to pulsed combustion devices. While it is appreciated that in any area dealing with combustion it is really not possible to precisely say exactly what is occurring, nevertheless based on observations of burner 10 in operation and certain measurements therefrom, the operation of burner 10 in conventional, accepted terminology is set forth below.

In its "at rest" condition, combustion air fills combustion chamber 18 because reeds 40 do not positively seal inlet openings 38 in the absence of combustion chamber pressure. Spark plug 44 is actuated and a spark develops at stabilizing rod 48 which spark remains on during the entire time burner 10 is operated. (While spark plug 44 could be fired intermittently, it is believed that the life of spark plug 44 would be several years if constantly operated during burner operation. Because of the cycle times and the cooling of combustion chamber 18, burner 10 is not self-igniting, at least not for residential applications.) Valve 62 is actuated by solenoids 64, 65 and injects through gas tube 52 a fixed volume of gas at a constant or metered flow rate. The combustion air within combustion chamber 18 is stationary. When the gas leaves gas tube 52 it is travelling at a sufficient velocity, force or momentum to drag some of the combustion air immediately therealong causing mixing therebetween. This mixture, which is initially only a partial amount, is directed over the sparking stabilizing rod 48 which initiates a volume combustion of fuel and air which will expand from the point of ignition, i.e. stabilizing rod 48, throughout the combustion volume as it is driven by the advancing mixing between the combustible gas and combustion air. By igniting the mixture, which is still in formation, a soft ignition is initiated which does not produce the sharp, loud noise of an explosion but which results in a soft puff which can be virtually noiseless. The flame front as shown in FIG. 4 thus starts or is propagated at the stabilizing rod 48 and spreads down the combustion chamber 18 as the combustible fuel and combustion air continue to mix, ignite and combust until such time as either the combustion air in the combustion chamber is all used up or at such time until the gas pulse or gas supply shuts off. The soft or noiseless ignition results because only a portion of the fuel and air have been mixed when ignition and combustion start to occur. It should be noted that the simultaneous mixing and combusting of fuel and air occurs in all continuous burners and in this sense, burner 10 can be viewed somewhat similar to that of continuous burners although in continuous burners the air and gas are both generally pressurized and reacted to cause the mixing. Accordingly, certain features used in continuous burners such as bluff bodies, maintenance of hot surfaces, multi-injection ports and swirling streams could, at least in theory, have some application to the present invention. However, a straight gas tube 52 with a properly sized fuel hole or nozzle located in proper spacing from spark plug 44 and specifically the orientation of stabilizing rod 48 with the spark plug electrode 45 positioned with respect to each other relative to combustion chamber 18 and gas outlet 53 has been found to be especially significant producing thorough combustion in a stabilized, consistent manner.

Now as a result of the combustion process, a fast rise in temperature and pressure is experienced inside combustion chamber 18. The temperature rise can be approximately calculated by calculating the adiabatic flame temperature and, by using Dalton's gas law, the pressure rise resulting from the rise in temperatures can be calculated. Dalton's law states that the pressure ratio between the highest combustion pressure and the atmospheric pressure is the same as the ratio of absolute temperature at the highest observed combustion temperature to the temperature of the combustion air prior to combustion, or ambient air temperature. Because of the difficulty of defining local temperatures and pressures in the described combustion process, mean values averaged over the combustion volume must be taken. This pressure ratio and the resulting thermal pressure rise calculated from minimum theoretical combustion temperatures can be as high as 7 which leads to a maximum pressure of 7 atmospheres at the peak of the combustion process. Actual observed values are somewhat lower due to the cooling of combustion gases during combustion, due to leaks at either end of the combustion chamber, and due to the fact that optimum combustion does not always take place at stoichiometric conditions but rather under slightly excess air for fuel-lean conditions. However, a forceful pressure pulse is created which can be harnessed and can be used to increase heat transfer, to lower $NO_x$ emissions, and to induce self-aspiration. Heat transfer is increased by the continuously accelerating and decelerating nature of the flow of hot combustion gases in contact with the heat transfer surfaces. As a result, boundary layer formation is impeded and secondary flows inside the boundary layer are induced. The results of these added influences can be measured as improved heat transfer fluxes which are higher than those calculated with conventional heat transfer relationships based on average flow conditions and gas properties. $NO_x$ emissions are reduced due to the extreme short times at which the combustion gases are at elevated pressures. Self-aspiration can be accomplished by providing a fast acting check valve or flapper valve, i.e. reeds 40, in the air inlet to the combustion chamber and providing either a high flow resistance or another check valve, i.e. 16, at the exit of the combustion apparatus. As the pressure is raised inside the combustion chamber, it can only relieve itself at the exhaust end. As the gases are cooled, the exhaust resistance is significantly larger than the entrance resistance which causes combustion air to be emitted preferentially into combustion chamber 18. The combustion chamber and heat transfer can be designed such that virtually clean combustion air is drawn into combustion chamber 18. In summary, burner 10 has some characteristics not entirely dissimilar to pulse combustion devices. The combustion of the gas and fuel over the pulse time limits (to be discussed below) create a surprisingly high pressure pulse at temperatures, believed somewhat higher than that produced in continuous burners. The pressure pulse resulting from the combustion enables burner 10 to be self-aspirating, and, as explained below, to also operate as a pump for enhanced system applications. One-way inlet valves combined also with a one-way exhaust valve are then utilized and inherently synchronized with the gas driven pulsations. Thus, a combustion system is produced where only the fuel is pulsed with electric or pneumatically actuated valves to cause a soft, quiet ignition which is very stable and consistent while at the same time generating the high temperatures and pressure pulses similar to that produced in pulse combustion systems (although perhaps not at the same high temperatures and pressures developed in those systems) which have been found sufficient to produce the self-aspiration needed to sustain the process without external blowers, fans, etc. and which, is also sufficient to use in other system applications.

Figure 1A:
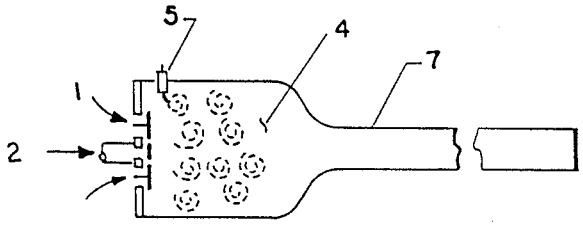
FIGS. 1*a*, 1*b*, 1*c* and 1*d* schematically illustrate the operation of prior art pulse combustion devices.
Figure 1B:
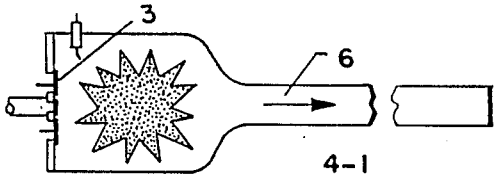
Figure 1C:
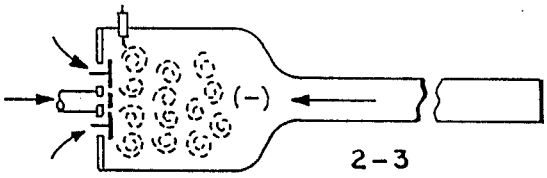
Figure 1D:
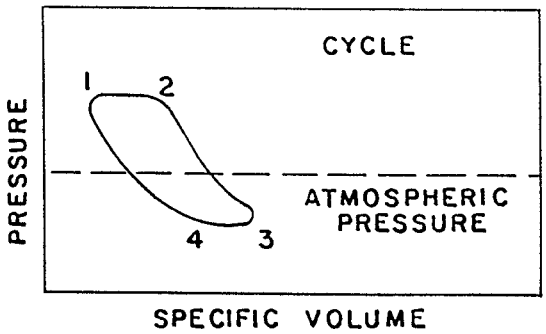
FIG. 1D PRIOR ART

The periodic operation of burner 10 may also be viewed to be similar to the pulse combustion cycle of the prior art shown in FIG. 1*d*. Actually, burner 10 could be viewed as having a cycle with a combustion stroke during which the pressure rises, an exhaust strike where the products of combustion are ejected from the combustion chamber because of the pressure from the combustion stroke which then results in a pressure drop causing combustion air to be admitted in the intake stroke. Fuel is then admitted to cause the combustion stroke, etc. Unlike pulse combustion, the strokes are externally regulated in a variable timed manner to produce soft ignition while retaining a pressure rise (and drop) and temperature increase, perhaps less than that achieved in pulse combustion systems, but certainly great enough to achieve the commercial objectives of the invention. As discussed above, the soft ignition is achieved by means of a free-standing gas jet which operates over a fixed, timed period and which is so sized to cause progressive entrainment and mixing of the combustible gaseous fuel with combustion air which (unlike continuous burner applications) is in an essentially quiescent or at rest state. That is the air which is drawn into the combustion chamber is essentially stationary when the fuel jet is activated, or if the combustion air is still moving, it is not moving with any momentum sufficient to interfere with the gas jet. The timing of the off cycle insures this. The invention is thus retaining certain aspects of the pulse combustion principle but modifying the combustion time and the time at which the combustion stroke occurs to produce a significant development in the burner art.

Unlike continuous burner applications, burner 10 is characterized by extremely high turndown ratios which can approach 50:1. As noted in the discussion above, pulse combustion devices have virtually no turndown ratio. This turndown ratio can be appreciated when it is realized that in addition to properly sizing the combustion chamber volume and the heat exchanger surface, several other considerations are of critical importance to the operation of burner 10. The amount of gas must be metered with comparable accuracy to assure proper stoichiometry and performance of burner 10. This is best accomplished by solenoid timers, 64, 65 which inject a metered amount of combustible gas upon each actuation. As discussed, this can also be achieved by a simple solenoid valve although any other timing device can be used. The time solenoid valves 64, 65 keep open fuel line 52 is the fuel injection time. This time must be properly chosen to insure proper operation of burner 10. The selection criteria is determined by the volume of the combustion chamber and by the frequency at which the valve 62 is operated. For example, if the frequency of combustion is 10 Hertz (i.e. the thermally pulsed combustion pulses ten times per second), then the air flow into the combustion chamber is about 36,000 (sixty seconds per minute times 60 minutes per hour to produce standard cubic feet per hour) multiplied by ten (the number of cycles) multiplied by the chamber volume. For a combustion chamber 18 with a volume of 0.025 cubic feet (43 cubic inches) the air flow will be 9,000 SCFH. This requires an injection of 90 SCFH of methane or 36 SCFH of propane to achieve stoichiometric combustion. The fuel injection must be accomplished at a rate of 3,600 times ten cycles. The time available for injection is determined by the time available for each fuel pulse. This time is based on the time which is left after the time necessary for aspiration has been allocated. For instance, with a pulsing rate of 10 Hertz, 100 microseconds are available for aspiration and injection. If 60 microseconds are needed for aspiration, then 40 microseconds remain for fuel injection. The time available for fuel injection is, therefore, mathematically solely dependant on the ratio of time for injection in comparison to total cycle time. In the example discussed, this ratio is 40 percent. The total fuel injection time therefore is also 40 percent. The total fuel input must be accomplished in 40 percent of the overall operation time. Fuel flow rate must be determined from this ratio in the overall intended fuel input. At the same time, in the operation of the burner, a relatively high fuel flow momentum is advantageous and necessary because it promotes mixing. The fuel burst which lasts 40 milliseconds in the example discussed must carry enough mixing energy to mix with the combustion air which is at relative rest when the fuel is being injected.

Figures 5A, 5B, 5C:
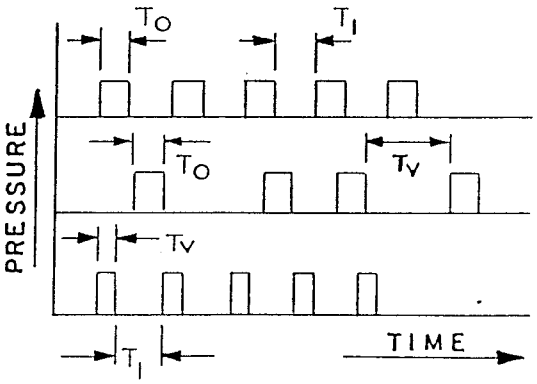
FIGS. 5*a*, 5*b* and 5*c* are graphs illustrating various periodic pulses at which the hybrid burner of the present invention can be operated.

Referring now to FIGS. 4 and 5a–5c, heat input control is achieved by two pulse timers 64, 65. As already noted, one timer 64 determines the actuation of the valve and the other timer 65 determines the deactivation of the valve. That is, one timer determines how long the fuel is shut off and the other how long the fuel is turned on. In actual operation, it is contemplated that only the off time will be monitored and the on time will be fixed or constant. This is perhaps best illustrated in FIG. 5B. In the graphs shown in FIGS. 5a–5c, the X axis represents the time and the Y axis represents the pressure of the gas in gas tube 52. In FIG. 5a, a series of regularly repeating pulses 70 are shown with each pulse representing the time that combustible gas is fed to combustion chamber 18 at a constant pressure. In FIG. 5a, a steady state operating condition at optimum process time is shown. Each pulse is on a constant time period $T_0$ and off for a constant time period $T_1$. One cycle, from the discussion above, equals $T_0$ plus $T_1$ and for the prototype discussed above, excellent operating characteristics were observed at 8 cycles per second, i.e. $8H_z$ and such characteristics continued over the range of approximately 3 to about $15H_z$. However, the invention should operate without any adverse results anywhere from about 1 cycle per second to about 30 cycles per second. As a point of reference or distinction, pulsed continuous burners operate with as short a cycle as about once every three seconds and pulsed combustion devices operate at about 50 to 60 cycles per second although in some instances operation has been reported in the neighborhood of 40 or so cycles per second.

As noted, the height of pulse 70 represents the pressure within gas tube 52 and that pressure must be sufficient to cause mixing of the stagnated combustion air within combustion chamber 18 with a sufficient momentum to assure continuous mixing and combustion as the flame front propagates from stabilizing rod 48. The $T_0$ and $T_1$ time intervals are determined in the manner described above. The area contained by each pulse 70 can be viewed as the total volume or mass of the combustible gas inJected into combustion chamber 18 and this volume of combustible gas must be in the appropriate proportion to the volume of combustion air within the combustion chamber to at least achieve stoichiometric combustion and perhaps slightly less to achieve lean or excess air operation. Thus, the width or the $T_0$ of each pulse 70 is critical to the efficient operation of the device if rich operating conditions and subsequent sooting are to be avoided. On the other hand, the off-time $T_1$ is not critical so long as the size of combustion air openings 38 is such to permit a sufficient volume of air to be drawn into and fill the combustion chamber 18 during the self-aspirating mode of the combustion cycle. As a point of reference, FIG. 5a shows the burner operating at "on" time $T_0$ which is equal to that needed to achieve stoichiometric combustion and at an "off" time $T_1$ which is the minimum time needed to fill combustion chamber 18 with quiescent air. As discussed, the fastest cycles for this to be accomplished could be as high as $30H_z$ but as a practical limit, more like $15H_z$. So long as the minimum $T_1$ time is met, the off-time can be extended to any duration. This is shown in FIG. 5b where the offtime $T_1$ in FIG. 5a becomes a variable $T_v$ and by this approach any turndown ratio can be achieved. That is, burner 10 could cycle in the multi-second range, but as a practical limit, the heat output at such range would be significantly reduced so that as a practical limit $T_v$ is set to limit the burner to $3H_z$ operation. As an arbitrary maximum practical value, the turndown ratio as high as 50:1 is specified. FIG. 5b represents the preferred embodiment of the invention in commercial form and is the reason why only one timed period, the off period, is controlled by the timer.

In FIG. 5c, the time of the on pulse $T_0$ is varied, i.e. $T_v$ to be less than $T_0$. That is, it is also possible to operate burner 10 in the manner shown in FIG. 5c to achieve a high turndown ratio. However, not all the combustion air within combustion chamber 18 will be combusted and a very lean or, alternatively stated, excess air condition will result. Obviously, the pressure of the combustion pulse developed when operating the burner in accordance with FIG. 5c will be less than what is otherwise possible. However, FIG. 5c is shown to demonstrate that it is possible to operate burner 10 under these conditions and, of course then, it is possible to operate burner 10 by varying both the time on-cycle to be less than $T_0$ and time off-cycle to be greater than $T_1$ assuming, for a given burner design, that $T_0$ represents the exact time where stoichiometric combustion will result and $T_1$ represents the minimum time needed to fill combustion chamber 18 with quiescent combustion air.

SYSTEM OPERATION

Generally, the structure of burner 10 has been described in FIGS. 2 and 3 and its method of operations has been described with reference to FIGS. 4 and 5a–5c. Also, the use of burner 10 in conventional, residential hot water heating systems has been briefly discussed with reference to FIG. 3. The schematic of a self-contained burner unit with a specific system design for burner 10 is shown in FIG. 6. More specifically, the system shown in FIGS. 6 has been developed for a marine application and specifically for use on sailing vessels and large motor powered ships having sleeping accommodations. Presently, such vessels are generally heated by electric heating units which heat a hydronic fluid. Fans and pumps are used in combination with various types of heat exchangers to pump the hydronic fluid in a closed loop so that hot water and heat can be provided in the vessel. When the vessel is docked, electricity from the dock is used to provide the heat. Away from the dock, a separate fuel powered generator must be operated. The generator is expensive and special precautions must be taken in the mounting of the generator which must be above board to avoid fumes which could lead to explosion, fire, etc. Because of safety regulations for vessels developed to prevent fire and explosion, bottled propane gas such as used in mobile RV recreational vehicles has not heretofore been used to heat sailing vessels and the like.

In the system shown in FIG. 6, like reference numerals will be used to designate the same parts and components of burner 10 as previously described. Combustion chamber 18 is housed by means of flange 28 within a sealed container 80 which is completely filled with a suitable hydronic fluid such as water and glycol. Secured to the other side of flange 28 is an airtight container 81 which contains feed chamber 19, end plate 20, solenoid 64 and a gas line 84 connected to a source of bottled gas (not shown). A fitting 85 communicates with the interior of airtight container 81 and secured to fitting 85 is an air line (not shown) which also contains gas line 84. The air and gas lines are plumbed through the vessel's deck structure to the outside air. In the event any leak develops, the fumes would be ported outside the vessel and would not collect within the hull to form a potentially explosive mixture. Burner 10 is similar to that described in FIG. 3 and the off-center location of exhaust opening 25 should be noted since its position within closed end 23 with respect to the operation of burner 10 is not critical. The exhaust path for the products of combustion is, as shown by the arrows in FIG. 6, through exhaust opening 25, through coils 13, past one-way check valve 16 and finally through a threaded exhaust port 87 in sealed container 80. An appropriate exhaust line (not shown) similarly vents the products of combustion through the vessel's bull to atmosphere. The entire unit is thus self-contained and is simply bolted into position.

In feed chamber 19 a pulse opening 89 situated approximately midway between the ignition point in combustion chamber 18 and gas orifice 53 is drilled and tapped. A pulse line 90 is then fitted to pulse opening 89 at one end thereof and at the other end is connected to an inlet stand pipe 92. A temperature and pressure relief valve 93 is provided for inlet stand pipe 92. Inlet stand pipe 92 communicates with the interior of sealed container 80 and an outlet stand pipe 95 also communicates with the interior of sealed container 80. In inlet standpipe 92, a column of hydronic fluid is provided beneath the point where gas pressure is introduced from pulse line 90 for dampening purposes. In outlet standpipe 95 a riser column is provided for dampening in accordance with conventional practice. Outlet stand pipe 95 is also in fluid communication with heaters 97 or heat exchange devices which are conventional. Check valves 98, 99 insure that the heated hydronic fluid travels in the direction of the arrows shown in FIG. 7. A return inlet 100 in sealed container 80 completes the return path.

It has been found that a significant pressure is developed through pulse opening 89 when the pressure wave is developed in combustion chamber 18 as the combustible gas and combustion air are ignited and combusted during the $T_0$ time period. For the small prototype burner having the dimensions noted above, a pressure of 10 inches W.C. was consistently observed in inlet stand pipe 92. It was also noted that during the intake stroke when an under pressure was developed in combustion chamber 18 to draw combustion air into combustion chamber 18, a pressure was also observed in pulse line 90. Thus, for each burner cycle two pulses were generated on the column of hydronic fluid contained in inlet stand pipe 92 which resulted in considerable flow of hydronic fluid through the system. A flow rate of about 30 GPH was observed for the prototype unit operating at a cycle of 10 Hz. Because of the pressure dampening effects of inlet and outlet stand pipes 92, 95 coupled with the relatively high number of pressure pulses in pulse line 90, little, if any, shock is imparted to the system and, surprisingly, an almost constant flow of hydronic fluid occurs throughout the system. This dampening—constant high flow rate means the system is entirely self-contained and significantly broadens its application for the residential, home heating market. For example, it can be easily inserted into hot water home heating systems or it can be easily substituted into conventional electric heat pumps. It can also function effectively as a gas powered air conditioning unit which would not necessarily need compressor and pumps for the refrigerant.

The invention has been described with reference to preferred embodiments. Obviously, modifications and alterations will occur to those skilled in the art. For example, there are any number of industrial applications where the higher heat output of burner 10 can be effectively utilized with or without modification to combustion chamber 18 such as burner swirl noted above. There are also numerous industrial processes where the system pump features of the invention can be utilized with or without a closed recirculation loop. It is my intention to include all such modifications and alterations insofar as they come within the scope of my invention.

It is thus the essence of my invention to provide an improved hybrid type burner which regulates only the fuel supply in a pulsed manner to develop not only an improved burner but also a burner having unique thermally developed pump characteristics which permit unique system applications for the burner.

Having thus defined the invention, I claim:

1. A method for generating periodic combustions in a combustion chamber having a one-way combustion air inlet, a one-way or restricted exhaust outlet and an externally actuated fuel inlet, said method comprising the steps of:

(a) admitting combustion air into said chamber during a first, finite period;

(b) thereafter admitting fuel into said chamber during a second timed, finite period;

(c) mixing, igniting and combusting said fuel with said combustion air during said second time period;

(d) thereafter beginning the first period by exhausting the products of combustion through said outlet, and (e) commencing said first timed period immediately upon expiration of said second time period whereby steps a through d are cyclically repeated.

2. The method of claim .1 wherein said fuel and said combustion air in step (c) are ignited and combusted while a combustible mixture of fuel and combustion air is still in formation to produce quiet ignition.

3. The method of claim 2 wherein during said second time period the heat liberated from the products of combustion cause a temperature rise in said combustion chamber and an attendant thermal pressure rise producing a pressure pulse acting on said products of combustion causing forceful expulsion of said products of combustion from said combustion chamber and a self-aspiration of combustion air into said chamber as said chamber cools.

4. The method of claim 3 wherein said cycles occur anywhere from about three cycles per second to fifteen cycles per second.

5. The method of claim 3 wherein a gaseous fuel is admitted under a generally constant pressure to said combustion sufficient to cause mixing of said fuel and said combustion air such that a combustible mixture of said fuel with said air is formed.

6. The method of claim 5 further including the steps of providing a spark plug electrode in said combustion chamber, providing a stabilizing rod in said combustion in spaced, angular relationship to said stabilizing rod in said combustion chamber in spaced, angular relationship to said stabilizing rod, generating a spark between said electrode and said rod whereby ignition occurs and stabilizing the combustion during said second time period at said rod.

7. The method of claim 5 wherein the mass volume of gas forced into said combustion during said second timed value is in fixed proportion to the volume of said combustion chamber to cause lean to stoichiometric combustion.

8. The method of claim 7 wherein the time of the first finite period is varied while the time of the second period is maintained to produce a wide turndown ratio.

9. The method of claim 8 wherein said turndown ratio can be as high as 50:1.

10. The method of claim 7 wherein the time of the first finite period is maintained constant and the time of the second finite period is reduced to produce a turndown ratio characterized by lean combustion.

11. A method for generating periodic combustion comprising:

(i) filling a combustion chamber with combustion air during a first time period;

(ii) thereafter injecting a fixed quantity of fuel into said chamber during a second time period and during said second time period mixing, igniting and combusting said fuel with the combustion air in a progressive manner until substantially all of said fuel has been converted into products of combustion to produce a pressure pulse;

(iii) exhausting as a result of said pressure pulse substantially all of said products of combustion from said combustion chamber through an exhaust passage; and (iv) cyclically repeating steps i, ii and iii to produce a series of combustion pulses.

12. The method of claim 10 wherein at least one of said time periods in steps i and ii can be varied in step iv to vary the total heat output produced by said products of combustion over a given number of cycles.

13. The method of claim 12 wherein said first time period is varied and said second time period is constant.

14. The method of claim 12 wherein said first time period is constant and second time period and said quantity of fuel injected into said combustion chamber in said second time period is varied.

15. The method of claim 12 wherein said first time period is cyclically varied and said second time period and said quantity of fuel injected into said combustion chamber is varied during said second time period.

16. The method of claim 11 wherein said step of filling said combustion chamber with combustion air occurs in a self-aspirating manner.

17. The method of claim 11 wherein said quantity of said fuel injected into said chamber is in stoichiometric proportion to the volume of combustion air in said combustion chamber.

18. The method of claim 11 wherein said fuel is pressurized in step ii at a value sufficient to cause mixing of said fuel with said combustion air and said mixture is directed past an igniter to develop a flame front, said flame front propagating in said combustion chamber until said quantity of fuel is substantially combusted.

19. The method of claim 11 wherein said fuel is pressurized in step ii at a value to cause mixing of said fuel with said combustion air and where this mixture is ignited and stabilized at one point of the combustion chamber which results in a flame which is virtually stationary during the length of the second time period.

20. The method of claim 5 wherein said fuel is admitted into said chamber as a free-standing jet, said combustion air in said chamber is in a quiescent state, said jet emanates at a point downstream of said ignition and causes mixing and entrainment of a portion of said combustion air with a portion of said fuel into a mixed portion of said air and fuel which is ignited quietly as it passes said ignition point and continues to mix and combust as jet travels through said combustion chamber.

21. The method of claim 11 wherein during said second time period the heat liberated from the products of combustion cause a temperature rise in said combustion chamber and an attendant thermal pressure rise producing a pressure pulse acting on said products of combustion causing forceful expulsion of said products of combustion from said combustion chamber and a self-aspiration of combustion air into said chamber as said chamber cools.

22. The method of claim 20 further including the steps of providing a spark plug electrode in said combustion chamber, providing a stabilizing rod in said combustion in spaced, angular relationship to said stabilizing rod in said combustion chamber in spaced, angular relationship to said stabilizing rod, generating a spark between said electrode and said rod whereby ignition occurs and stabilizing the combustion during said second time period at said rod.

23. A method for generating and using periodic combustion wherein fuel and combustion air are intermittently combusted to produce intermittent pressure waves acting on the products of combustion for heat transfer purposes, said method comprising the steps of:

(a) providing a combustion chamber having a one-way air inlet opening whereby combustion air can enter said chamber but not exit from said inlet, a one-way exhaust opening permitting only escape of fluid from said chamber, and a fuel gas inlet;

(b) pulsing a metered quantity of fuel gas into said combustion chamber at periodic intervals through said gas inlet;

(c) combusting said gas with combustion air in said chamber during the time said fuel gas is injected into said chamber whereby said pressure wave is generated with little noise;

(d) combusting said fuel gas air mixture in an intermittently stationary flame which s stabilized by a rod; and (e) providing a container filled with hydronic fluid into which said combustion chamber is submerged, and heating said hydronic fluid by said combustion chamber and said pressure wave.

24. The system of claim 23 further including the steps of providing said hydronic container with a first outlet, a return outlet and a pulse inlet, and periodically pressurizing said pulse inlet by said pressure wave to cause said hydronic fluid to leave said hydronic container from said first outlet and return thereto from said return outlet.

25. The system of claim 23 further including the step of providing said pulse inlet with a standpipe filled with hydronic fluid and in fluid communication with said hydronic container and dampening said periodic pressurizations at said pulse inlet by said standpipe.

26. The system of claim 24 wherein combustion air is admitted into said combustion chamber during a first time period and said gaseous fuel is admitted into said combustion chamber during a second time period and during said second time period the heat liberated from the products of combustion cause a temperature rise in said combustion chamber and an attendant thermal pressure rise producing a pressure pulse acting on said products of combustion causing forceful expulsion of said products of combustion from said combustion chamber and a self-aspiration of combustion air into said chamber as said chamber cools.

27. The system of claim 25 further including the steps of providing a spark plug electrode in said combustion chamber, providing a stabilizing rod in said combustion in spaced, angular relationship to said stabilizing rod in said combustion chamber in spaced, angular relationship to said stabilizing rod, generating a spark between said electrode and said rod whereby ignition occurs and stabilizing the combustion during said second time period at said rod.

28. A pulse combustion system comprising a combustion chamber having means forming a one-way air inlet opening, means forming a one-way exhaust outlet and a fuel inlet, ignition means in said chamber for igniting a combustible mixture of air and fuel in said chamber;

gas pressurizing means for pressurizing a source of fuel in fluid communication with said gas inlet, and timing valve means cooperating with said gas pressurizing means for pulsing a metered amount of fuel during a fixed time period through said fuel inlet whereby said fuel is essentially mixed and combusted simultaneously as it is metered into said combustion chamber to produce a pressurized pulse at low noise levels.

29. A burner comprising:

(a) a combustion chamber having an air inlet, a fuel inlet and an outlet;

(b) air inlet valve means permitting one-way combustion air flow into said chamber;

(c) exhaust valve outlet means permitting one-way exhaust flow out of said chamber;

(d) a fuel regulator for maintaining fuel at a generally constant pressure at said fuel inlet;

(e) timing valve means providing fluid communication with said chamber during a timed interval sufficient only to permit a metered quantity of fuel in no more than stoichiometric proportion to the combustion air volume in said chamber to enter said combustion chamber during said interval;

(f) ignition means effective to initially combust a portion of said fuel as it enters said combustion chamber and continue said combustion of said fuel during said timed interval.

30. The burner of claim 28 comprising spark igniting means which further reduces combustion noise and which improves utilization of the combustion chamber volume by increasing stabilization of the combustion.

31. The burner of claim 28 wherein the length of the combustion chamber from fuel inlet point to combustion chamber exhaust is preferentially between 175 and 250 times the diameter of the fuel inlet nozzle.

32. The burner of claim 29 wherein flame in said combustion chamber is stabilized on a rod which serves simultaneously as grounding point for spark ignition.

33. The burner of claim 29 wherein said igniting means includes a spark plug electrode extending into said combustion chamber and a stabilizing rod spaced a close distance to said electrode whereby a spark is generated across said electrode and said rod while a flame is propagated and stabilized at said rod.

34. The burner of claim 33 wherein said electrode and said rod form an angle of about 90° in one plane and an angle of about 180° in a second plane orthogonal to the first plane.

35. The burner of claim 29 wherein said combustion chamber is cylindrical, a cylindrical feed chamber secured at one end to said combustion chamber and an end plate secured to the other end of said feed chamber, said air inlet valve means including reed valves disposed in said end plate for covering and uncovering holes in said end plate.

36. A heat exchange system comprising:

(a) a combustion chamber immersed in a container filled with hydronic fluid, said combustion chamber having an outlet extending through said container and vented to atmosphere, an inlet, and spark igniter means extending therein for igniting a combustible mixture of fuel and combustion air;

(b) end plate means secured to said inlet of said combustion chamber and having associated therewith one-way inlet valve means for admitting combustion air intermittently into said combustion chamber, fuel inlet for admitting gaseous fuel under pressure, and a pulse outlet opening upstream of said spark igniter means;

(c) timing means for periodically admitting a fixed quantity of fuel at a generally constant pressure within a timed interval to said combustion chamber whereby periodic combustion cycles occur therein;

(d) one-way exhaust means associated with said combustion chamber's outlet permitting fluid communication from said combustion chamber to atmosphere but preventing communication from ambient atmosphere to said combustion chamber;

(e) an outlet from said container and a return inlet into said container, a line with one-way valve means for carrying said hydronic fluid from said outlet to said return inlet and at least one heat exchange device in said line for recovering heat from said hydronic fluid; and (f) said container further having a pulse inlet and a line from said pulse outlet opening to said pulse inlet for periodically pressurizing and causing pulses of fluid movement from said outlet to said return inlet while combustion cycles are occurring within said combustion chamber, said combustion cycles simultaneously heating said hydronic fluid in said container.

37. The system of claim 35 wherein said pulse inlet has a standpipe filled with hydronic fluid upon which said pulses act to dampen the surges of said pulses.

38. The system of claim 36 wherein said container outlet has a standpipe filled with fluid to dampen any surge of hydronic fluid forced from said container by said pressure in said pulse line.

39. The system of claim 37 wherein said pulses in said pulse line are produced during each time combustion occurs in said combustion chamber and during each time combustion air is drawn into said combustion chamber.

40. The system of claim 38 wherein said spark igniting means includes a spark plug electrode extending into said combustion chamber and a stabilizing rod spaced a close distance to said electrode whereby a spark is generated across said electrode and said rod while a flame is propagated and stabilized at said rod.

41. The burner of claim 40 wherein said electrode and said rod form an angle of about 90° in one plane and an angle of about 180° in a second plane orthogonal to the first plane.

42. The system of claim 40 wherein said combustion chamber is cylindrical; said end plate means includes a cylindrical feed chamber secured at one end to said combustion chamber and an end plate; said end plate secured at the other end of said feed chamber, said end plate containing said one-way air inlet valve means and said pulse outlet opening located approximately midway in said feed chamber.

* * * * *